US009904239B1

(12) United States Patent
Ballman et al.

(10) Patent No.: US 9,904,239 B1
(45) Date of Patent: Feb. 27, 2018

(54) FUSER ARCHITECTURE FOR ENABLING INTERCHANGEABILITY IN AN IMAGING DEVICE

(71) Applicant: LEXMARK INTERNATIONAL, INC., Lexington, KY (US)

(72) Inventors: Karen Elaine Ballman, Nicholasville, KY (US); Patrick Wayne Carr, Jr., Corinth, KY (US); Gregory Daniel Creteau, Winchester, KY (US); Clark Edward Jarnagin, Richmond, KY (US); Donald Eugene Proffitt, Richmond, KY (US); Edward Alan Rush, Richmond, KY (US); Edward Lynn Triplett, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/334,576

(22) Filed: Oct. 26, 2016

(51) Int. Cl.
*G03G 15/20* (2006.01)
*G03G 21/16* (2006.01)
*G03G 15/00* (2006.01)

(52) U.S. Cl.
CPC ..... *G03G 21/1685* (2013.01); *G03G 15/2089* (2013.01); *G03G 15/5029* (2013.01); *G03G 21/1619* (2013.01); *G03G 2215/2009* (2013.01); *G03G 2221/169* (2013.01); *G03G 2221/1639* (2013.01)

(58) Field of Classification Search
CPC ..... G03G 15/2089; G03G 15/5029; G03G 21/1619; G03G 21/1685
USPC ..... 399/107, 110, 122
See application file for complete search history.

(56) References Cited

U.S. PATENT DOCUMENTS 7,822,361 B2 * 10/2010 Ishino ..... G03G 21/1685 399/122
7,885,555 B2 * 2/2011 Obata ..... G03G 21/1685 399/122
8,908,243 B2 * 12/2014 Takemura ..... G03G 15/2028 399/122

* cited by examiner

*Primary Examiner* — William J Royer

(57) ABSTRACT

An imaging device having a fuser and print engine architecture that enables complete interchangeability between fuser types with a common print engine. The imaging device has a frame configured to separately receive a first fuser assembly of a first fuser type and a second fuser assembly of a second fuser type different from the first fuser type. The first fuser assembly includes a first fuser frame having a first datum tab. The second fuser assembly includes a second fuser frame having a second datum tab. The frame of the imaging device has a datum aperture that is sized to receive the first datum tab that when inserted into the datum aperture, causes the first fuser assembly to be positioned at a first operative position, and the second datum tab that when inserted into the datum aperture, causes the second fuser assembly to be positioned at a second operative position.

15 Claims, 15 Drawing Sheets

FUSER ARCHITECTURE FOR ENABLING INTERCHANGEABILITY IN AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The present disclosure relates generally to fuser assemblies interchangeable with a common print engine for an imaging device.

Description of the Related Art

Electrophotographic (EP) printers utilize different fuser technologies to meet unique customer needs. For example, EP printers utilize the belt fuser technology for customers who benefit from power and time savings since such technology is optimized for lower energy, faster time to first print and copy, and robust media handling for general office media including paper labels and smaller narrow media job sizes. Whereas the belt fuser is an excellent technology for most customers who in turn benefit from power and time savings, such fuser technology fails to support customers which deploy EP printers in non-traditional and demanding applications such as vinyl label printing (i.e., contamination without an oil impregnated cleaner wiper) and large batch narrow media applications. To remedy this, the hot fuser roll technology, which excels in addressing such applications, is used.

The serial design execution of the two machine types resulted in several unique hardware elements including the print engine frames, drive train, paper path, and rear cover. Fundamentally, these are two different machines that do not have interchangeable fusers and could not be converted from one machine type to the other. Consequently, this limited model convertibility and flexibility when managing inventory levels, required additional tooling and manufacturing overhead, required significant incremental development and testing resources.

SUMMARY OF THE INVENTION

Example embodiments of the present disclosure enable interchangeability between fuser types with a common print engine. In one example embodiment, an imaging device includes a frame configured to separately receive a first fuser assembly of a first fuser type and a second fuser assembly of a second fuser type different from the first fuser type. The first fuser assembly is removably mounted to the frame at a first operative position when the first fuser assembly is installed in the imaging device. The second fuser assembly is removably mounted to the frame at a second operative location different from the first operative position when the second fuser assembly is installed in the imaging device.

In another example embodiment, an imaging device includes a housing, an access door on the housing having a media guide member attached thereto, and a frame configured to separately receive a first fuser assembly of a first type and a second fuser assembly of a second type, each of the first and second fuser assemblies having a fuser nip, an exit roll pair defining an exit nip downstream of the fuser nip in a media feed direction, a pair of guide members positioned downstream of the exit nip in the media feed direction, the pair of guide members interleaving with the media guide member attached to the access door to form an exit media guide surface for receiving fused media exiting the exit nip, and a media sensor for sensing media exiting the fuser nip. The media sensor of the first fuser assembly is disposed upstream of the exit nip of the first fuser assembly in the media feed direction. The media sensor of the second fuser assembly is disposed downstream of the exit nip of the second fuser assembly in the media feed direction on one of the pair of guide members of the second fuser assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

DETAILED DESCRIPTION

Figure 1A:
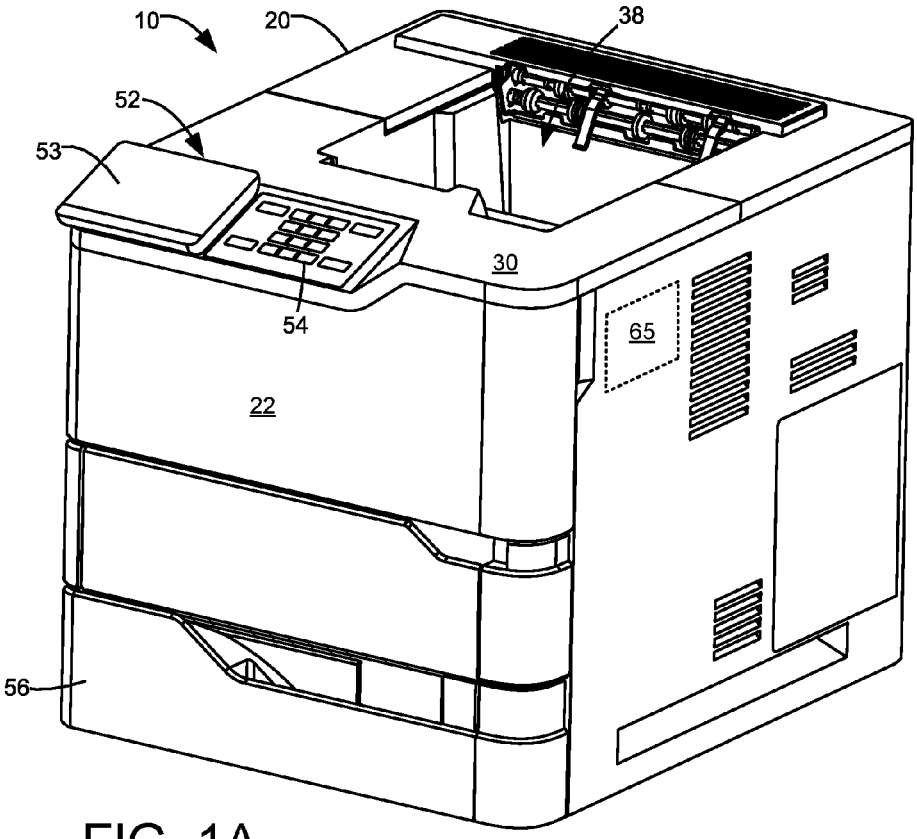
FIGS. 1A and 1B are front and rear perspective views of an imaging device according to an example embodiment, respectively.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device. The terms "front" "rear" "left" and "right" as used herein for the removable media tray and its components are with reference to the removable media tray being inserted in the imaging device or option assembly as viewed in FIG. 1.

As used herein, the term "communication link" is used to generally refer to structure that facilitates electronic communication between multiple components, and may operate using wired or wireless technology. Communications among components may be done via a standard communication protocol, such as for example, universal serial bus (USB), Ethernet, or IEEE 802.xx.

Figure 1B:
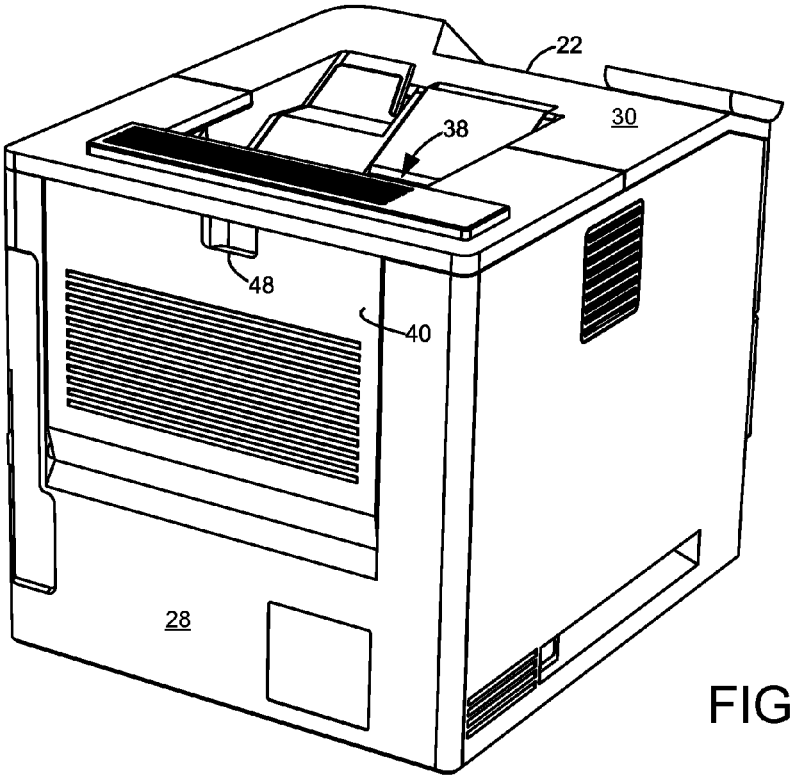

FIGS. 1A-1B are front and rear perspective views, respectively, of an imaging device 10. Imaging device 10 includes a housing 20 having a front 22, a rear 28, and a top 30. A media output area 38 is provided on top 30 for printed media exiting imaging device 10. A rear access door 40 is provided on rear 28. A door release 48 may be provided along a top portion of rear access door 40 for allowing access into the interior of imaging device 10 in order to clear a jammed sheet of media from the media path within imaging device 10 or to replace worn components thereof. A removable media tray 56 for providing media to be printed is slidably inserted into imaging device 10 through an opening provided along front 22.

Controller 65 is mounted within imaging device 10 and is used to control operation of imaging device 10, including a drive motor (not shown) used to rotate one or more feed roll pairs to convey media through imaging device 10, motors (not shown) for a pick mechanism for feeding media sheets from the removable media tray 56, and imaging operations, such as printing. A user interface 52 including a display 53 and a key panel 54 is provided along top 30 of imaging device 10. User interface 52 is in operable communication with controller 65. Using the user interface 52, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like.

Controller 65 includes a processor unit and associated memory and may be formed as one or more Application Specific Integrated Circuits (ASICs). The associated memory may be, for example, random access memory (RAM), read only memory (ROM), and/or non-volatile RAM (NVRAM). Alternatively, the associated memory may be in the form of a separate electronic memory (e.g., RAM, ROM, and/or NVRAM), a hard drive, a CD or DVD drive, or any memory device convenient for use with the controller 65. Controller 65 may be illustrated in the figures as a single entity but it is understood that controller 65 may be implemented as any number of controllers, microcontrollers and/or processors.

Figure 2:
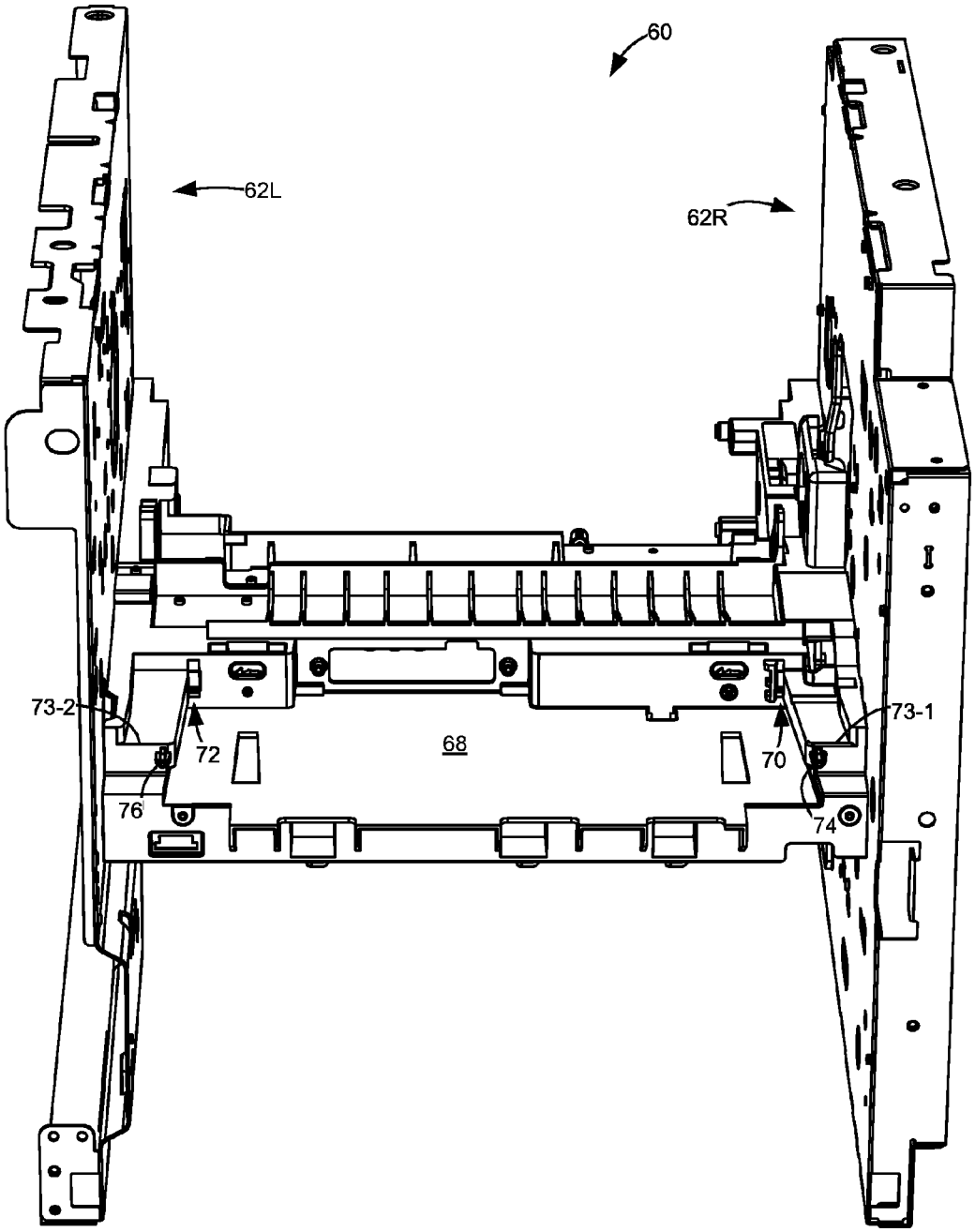
FIG. 2 is a perspective view of an imaging device frame along FIG. 1B with an access door thereof removed.

FIG. 2 is a perspective view of a frame 60 of imaging device 10. Frame 60 is used to support the internal components of imaging device 10. Frame 60 includes at least left and right side panels 62L, 62R, respectively, as well as a front panel (not shown, for purposes of clarity) that define a volume of imaging device 10 in which the internal components are disposed. Frame 60 also includes a plate 68 extending between left and right side panels 62L, 62R of frame 60. Plate 68 includes first and second datum apertures 70, 72 disposed along a portion thereof adjacent the interior portion of imaging device 10. Guide rails 73-1, 73-2 are provided on opposite sides of frame 60 to facilitate insertion of a fuser assembly into imaging device 10. Alignment members 74, 76 extend outwardly from respective guide rails 73-1, 73-2.

Figure 3:
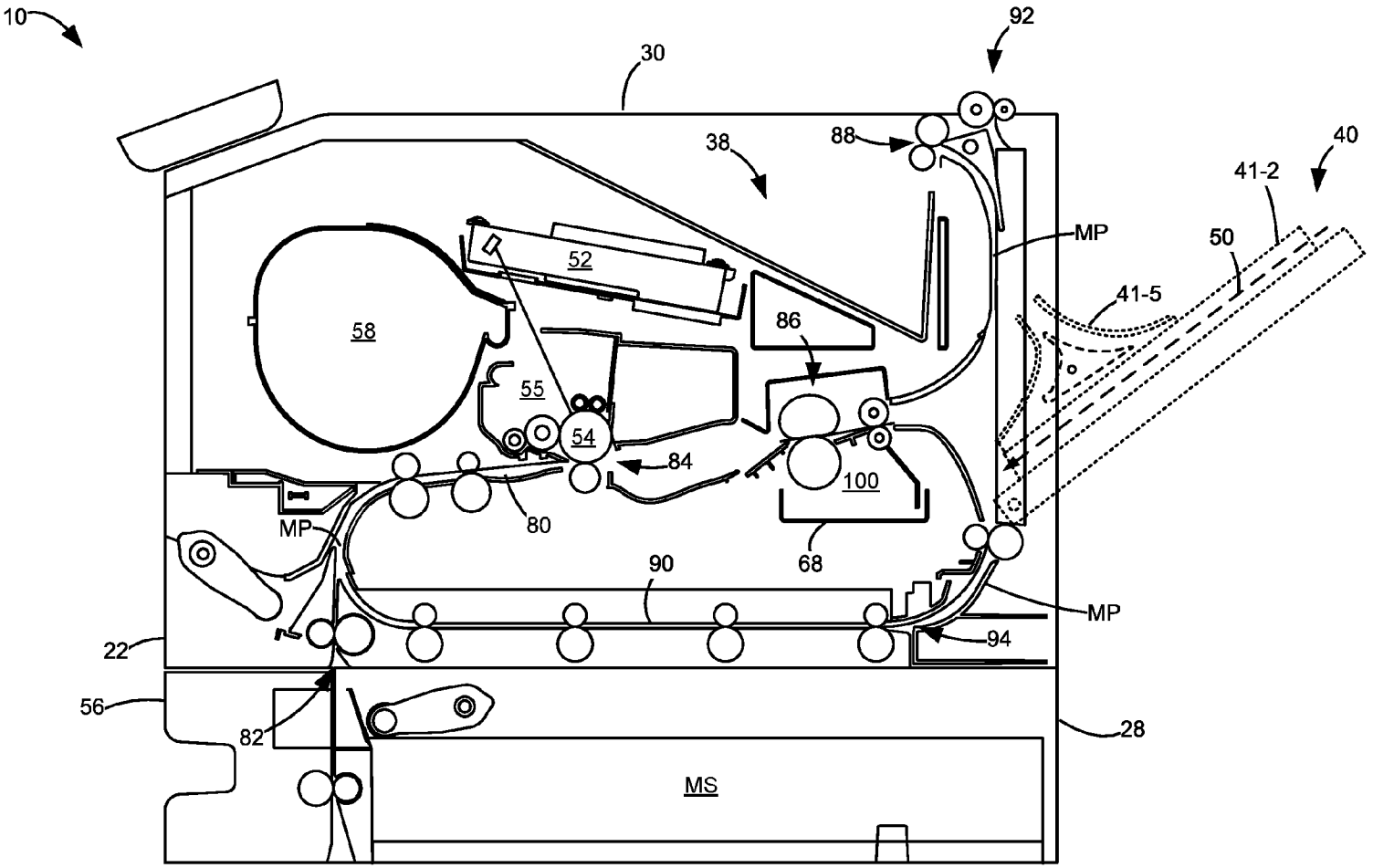
FIG. 3 is a simplified schematic diagram showing components and media path of the imaging device in FIGS. 1A and 1B showing movement of the access door.

FIG. 3 is a simplified schematic diagram of imaging device 10. Imaging device 10, an electrophotographic imaging device, includes a laser writing unit 52 which creates a latent image on a charged photoconductive member 54 in imaging unit 55. A toned image corresponding to the latent image is formed on photoconductive member 54 in imaging unit 55 using toner supplied by a toner bottle 58. The toned image is transferred from photoconductive member 54 to a sheet of media picked from media stack MS at a transfer nip formed in part by photoconductive member 54, through which the media sheet passes. The media sheet then passes through removable fuser assembly 100 or 200 whereupon the toner particles forming the toned image are fused to the media sheet by application of heat and pressure. The media sheet is then moved through exit nip 88 to media output area 38. Relative to the view provided by FIG. 3, a media path MP of the media sheet, as it is moved from media stack MS to media output area 38, has an inverted S-shape. The process of forming printed media using an electrophotographic process is well known in the art such that details will not be provided for reasons of expediency.

FIG. 3 shows movement of door 40 as it moves between an open position and a closed position. When in the open position, door 40 provides access to portions of media path MP in imaging device 10. A simplex portion 80 of media path MP extends from an entrance 82 located adjacent to removable media tray 56 through the transfer nip, a fusing area 86 where toner is fused to the media sheet in fuser assembly 100, and exit nip 88 to media output area 38. A duplex path portion 90 of media path MP includes an entrance 92 adjacent to exit 84 of simplex portion 80 and an exit 94 which merges with simplex portion 80 just downstream of entrance 82 thereof.

Portions of door 40 form part of simplex and duplex portions 80, 90, respectively, of media path MP. In one example embodiment, an inner surface 41-2 of door 40 includes a media guide member 41-5 having a set of media guide ribs (shown in FIG. 7B) cantilevered from top and bottom portions of door 40. Door 40 further includes a slot 50 extending from a top to a bottom edge thereof. In FIG. 3, media guide member 41-5 forms a portion of simplex portion 80 while slot 50 forms a portion of duplex path portion 90 of media path MP. When door 40 is moved to the closed position, door 40 orients media path MP for moving a sheet of media as part of a printing operation. Fusing area 86 includes plate 68 (shown in FIG. 2) which includes a removable fuser assembly positioned nearby door 40. The removable fuser assembly may either be a belt fuser assembly 100 (shown in FIGS. 4A-4B) or a hot roll fuser assembly 200 (shown in FIGS. 5A-5B). When door 40 is in the open position, one of the fuser assemblies 100, 200 installed may be unlocked and removed from imaging device 10.

Figure 4A:
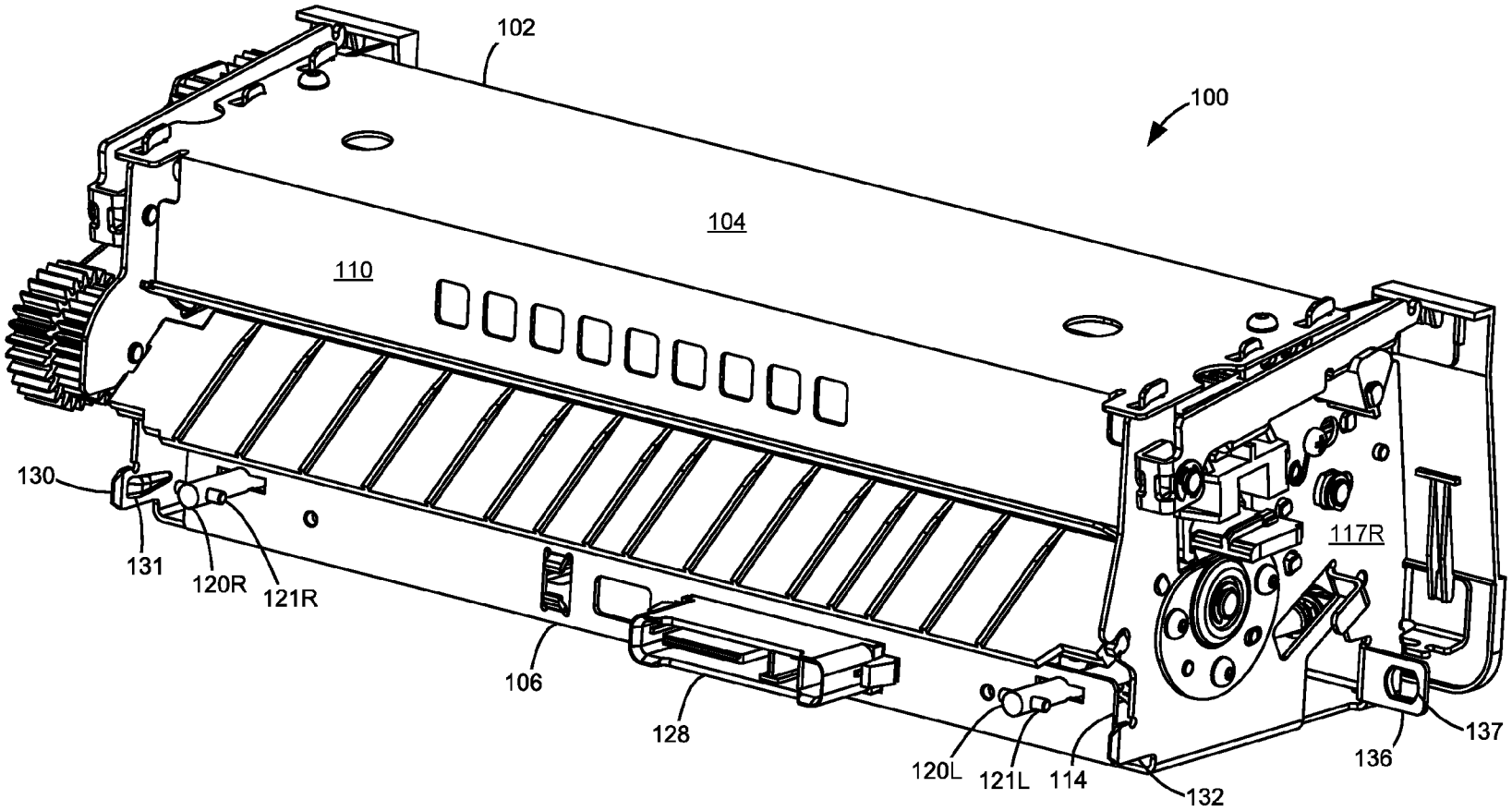
FIGS. 4A and 4B are front and rear perspective views of a removable belt fuser assembly of the imaging device in FIGS. 1A and 1B, according to an example embodiment.
Figure 4B:
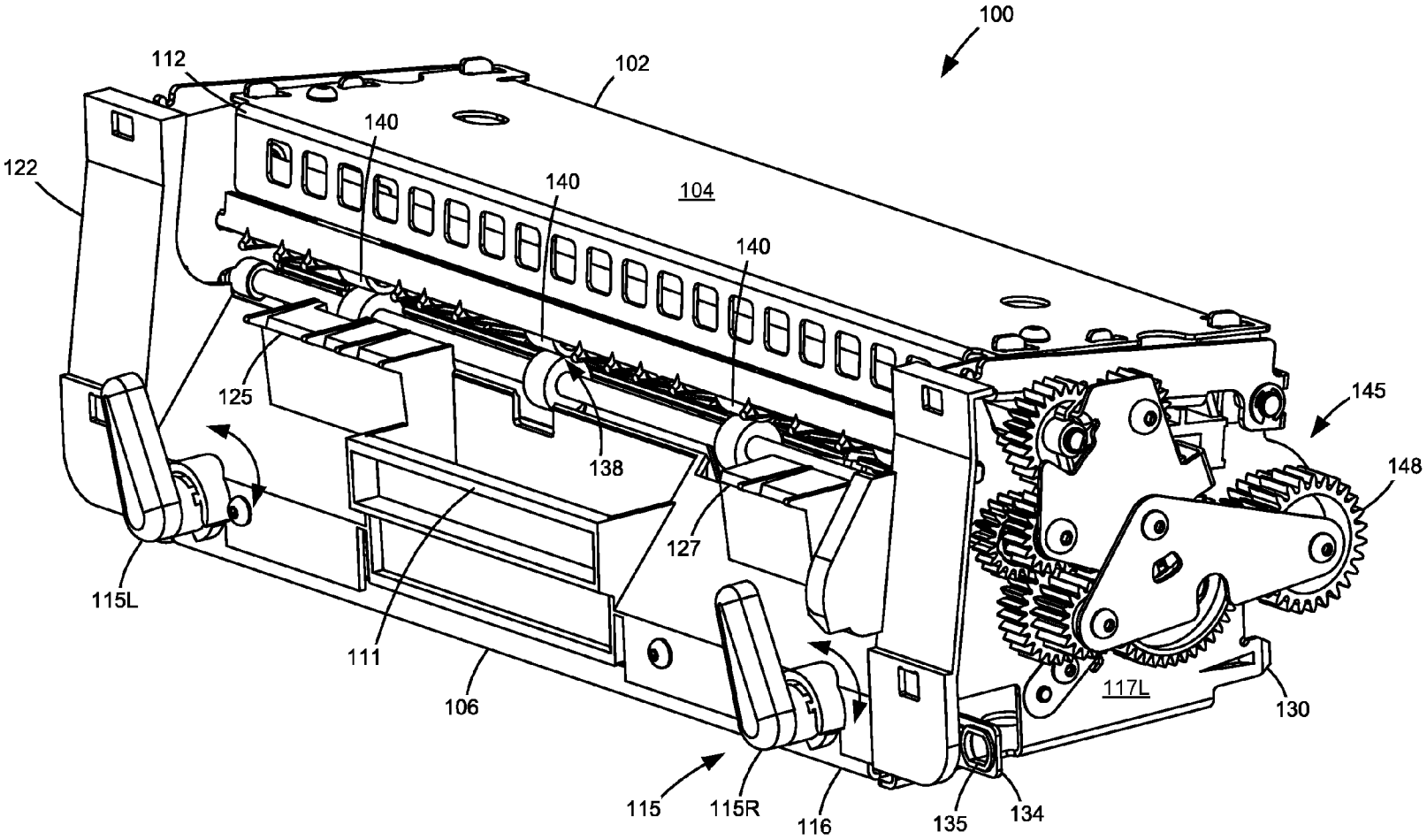
Figure 5A:
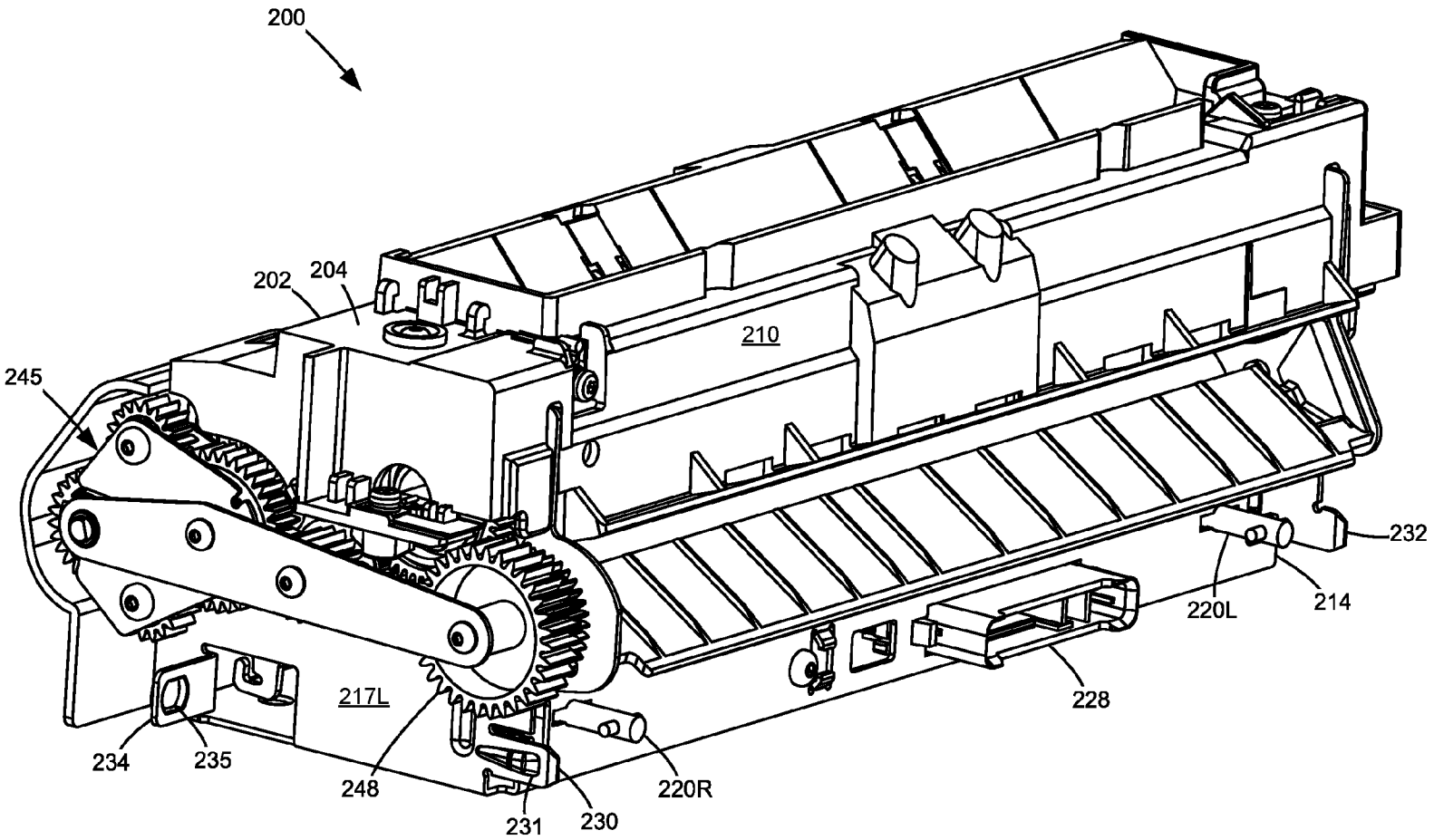
FIGS. 5A and 5B are front and rear perspective views of a removable hot roll fuser assembly of the imaging device in FIGS. 1A and 1B, according to an example embodiment.
Figure 5B:
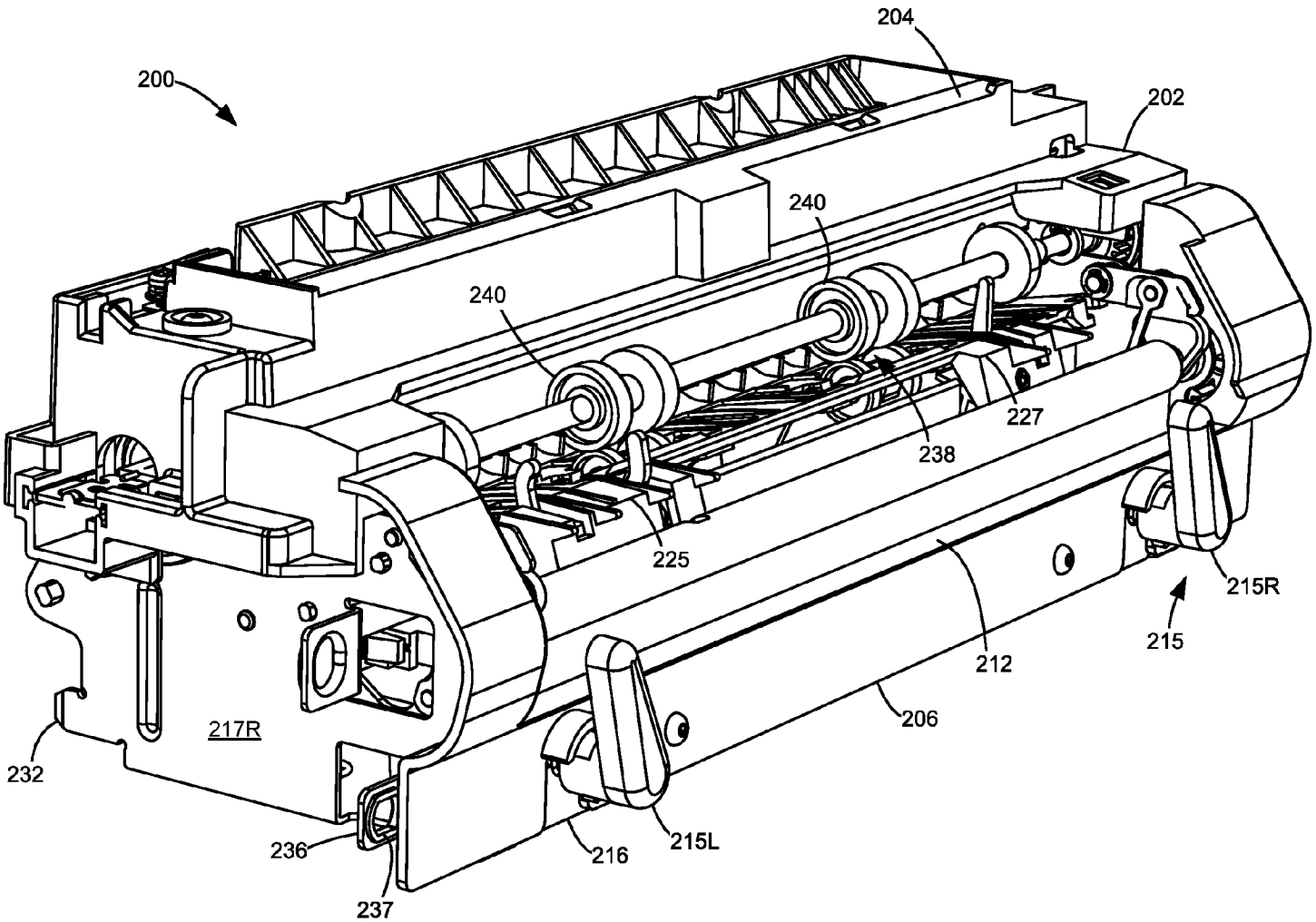

FIGS. 4A-4B are perspective views of belt fuser assembly 100 according to an example embodiment. FIGS. 5A-5B are perspective views of a hot roll fuser assembly 200 according to an example embodiment. FIGS. 4A and 5A are front perspective views of belt fuser assembly 100 and hot roll fuser assembly 200, respectively, while FIGS. 4B and 5B are rear perspective views of belt fuser assembly 100 and hot roll fuser assembly 200, respectively.

In FIGS. 4A-5B, each of the belt and hot roll fuser assemblies 100, 200 includes respective fuser frames 102, 202 including a variety of substantially ridged members such as plates, bars, and the like securely affixed to one another to form a substantially ridged supporting structure for the remaining components of both belt fuser assembly 100 and hot roll fuser assembly 200. Fuser frames 102, 202 are adapted for mounting in imaging device 10 interchangeably, and may be provided as a customer replaceable unit (CRU) or a field replaceable unit (FRU).

With reference to FIGS. 4A-4B, belt fuser assembly 100 includes the fuser frame 102 having a top 104, bottom 106, front 110, and rear 112. A front plate 114 and a back plate 116 are provided on front and rear 110, 112 portions of fuser frame 102. Back plate 116 of fuser frame 102 includes grip 111 for users to utilize in installing and removing belt fuser assembly 100 to and from fusing area 86 (FIG. 3) of imaging device 10, respectively. A locking mechanism 115 having left and right handles 115L, 115R to which a first end of mounting shafts 120L, 120R mounted on the fuser frame 102 are inserted, respectively. Pin members 121L, 121R having a pair of radially extending segments are disposed at a second end of mounting shafts 120L, 120R, respectively. Each of the left and right handles 115L, 115R is rotatable in a first direction and a second direction opposite the first direction (indicated by rotational arrows in FIG. 4B) to lock belt fuser assembly 100 to frame 60 of imaging device 10. Rotational movement of mounting shafts 120L, 120R causes respective pin members 121L, 121R to travel along the first and second camming profiles of the imaging device frame plate. Belt fuser assembly 100 is moved to a locked position following completion of the segments of pin members 121L, 121R travelling along the first and second camming profiles in the first direction and is moved to an unlocked position following completion of the segments of pin members 121L, 121R travelling along the camming profiles in the second direction. A cover member 122 having guide members 125, 127 for interleaving with media guide member 41-5 (FIG. 7B) of door 40, is mounted on back plate 116 of fuser frame 102. An electrical connector 128 to establish electrical connection between the belt fuser assembly 100, controller 65 and a power supply of imaging device 10 (not shown) is positioned on the front plate 116 of fuser frame 102.

A right plate 117R and a left plate 117L are provided on right and left side portions of fuser frame 102, respectively. First and second belt fuser datum tabs 130, 132 extend outwardly from respective right and left plates 117R, 117L adjacent the front plate 116 in a direction of insertion of belt fuser assembly 100 into imaging device 10 for ensuring the positional alignment of belt fuser assembly 100 therein. First belt fuser datum tab 130 includes a protrusion 131 projecting in a first direction transverse to the direction of insertion of belt fuser assembly 100. Third and fourth belt fuser datum tabs 134, 136 having respective openings 135, 137 extend outwardly from respective right and left plates 117R, 117L for receiving respective alignment members 74, 76 (FIG. 2) of imaging device 10 when belt fuser assembly 100 is inserted into imaging device 10.

Figure 6A:
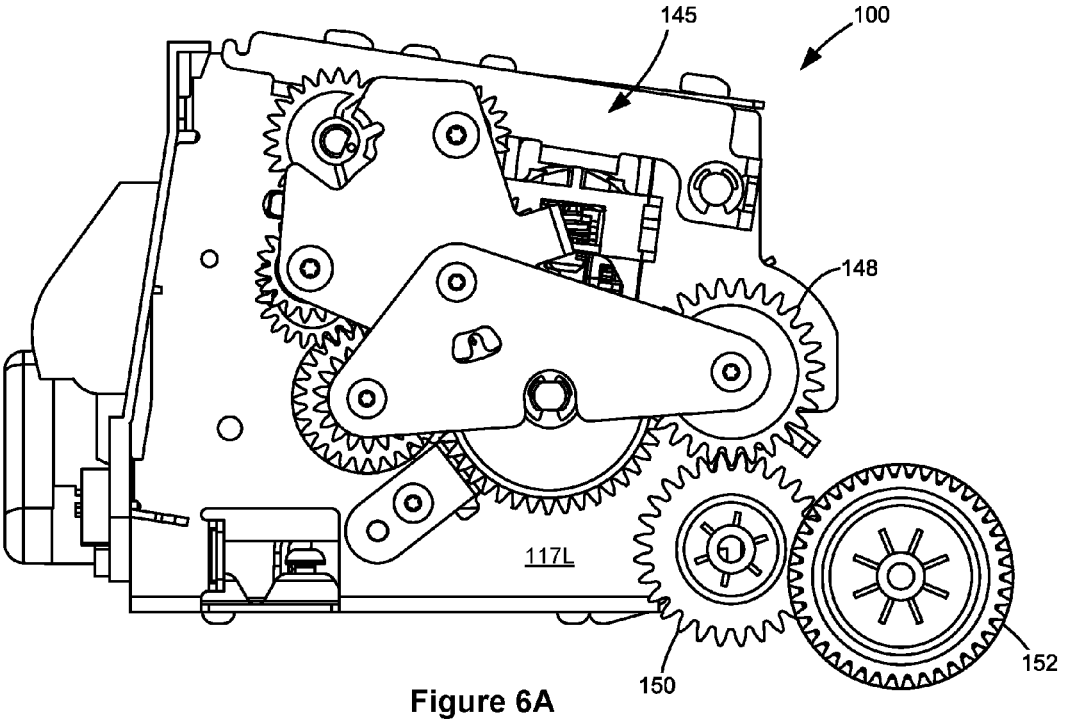
FIGS. 6A and 6B are side views of the removable belt fuser assembly of FIGS. 4A and 4B and the hot roll fuser assembly of FIGS. 5A and 5B, respectively.

As is known in the art, belt fuser assembly 100 includes an endless belt (not shown) and an opposed backup member, such as a backup roll (not shown) forming a fuser nip (not shown) through which media is passed to fix a toner image onto the media under heat and pressure. The print media may travel along the media path MP through fusing nip and exits belt fuser assembly 100 through an exit nip 138 between one or more pairs of exit rollers 140 towards exit nip 88 in the media path MP (shown in FIGS. 4A-4B). An exit sensor (not shown) may be positioned at a location along the media path MP upstream of the exit nip 138 to detect the presence of print media as it leaves the fuser nip. A drive train 145, as shown in FIGS. 4B and 6A, is positioned on right plate 117R of fuser frame 102 to drive various rolls, such as the backup roll within belt fuser assembly 100.

Referring to FIGS. 5A-5B, hot roll fuser assembly 200 includes a fuser frame 202 having a top 204, bottom 206, front 210 and rear 212. A front plate 216 and a back plate 214 are provided on the front and rear 210, 212 of fuser frame 202, respectively. A locking mechanism 215, similar to the locking mechanism 115 of belt fuser assembly 100 as described above, having left and right handles 215L, 215R connected to an end of mounting shafts 220L, 220R mounted on the fuser frame 202, respectively, is used to lock hot roll fuser assembly 200 to frame 60 of imaging device 10. An electrical connector 228, to establish electrical connection between the hot roll fuser assembly 200, controller 65 and a power supply (not shown) is positioned in about the same location as electrical connector 128 of the belt fuser assembly 100.

A right plate 217R and a left plate 217L are provided on right and left side portions of fuser frame 202, respectively. First and second hot roll fuser datum tabs 230, 232 extend outwardly from respective right and left plates 217R, 217L adjacent the front plate 216 in a direction of insertion of hot roll fuser assembly 200 into imaging device 10 for ensuring the positional alignment of hot roll fuser assembly 200 therein. First hot roll fuser datum tab 230 includes a protrusion 231 projecting in a second direction opposite to the first direction of the protrusion 131 of first belt fuser datum tab 130. Third and fourth hot roll fuser datum tabs 234, 236 having respective openings 235, 237 extend outwardly from respective right and left plates 217R, 217L for receiving respective alignment members 74, 76 of imaging device 10 when hot roll fuser assembly 200 is inserted into imaging device 10.

As is known in the art, hot roll fuser assembly 200 includes a hot roll (not shown) heated in a known manner, such as by a lamp within the hot roll, and mounted into fuser frame 202 by use of bearings or the like. The print media (not shown) may travel along the media path MP through a fuser nip (not shown) between the hot roll and a pressure roll (not shown), and exits hot roll fuser assembly 200 through an exit nip 238 between one or more pairs of exit rollers 240 towards exit nip 88 in the media path MP as shown in FIG. 3A. In FIG. 5B, a first guide member 225 having a narrow media sensor may be positioned at a location along the media path MP downstream of exit nip 238 to detect the presence of sheets of narrow media such as envelopes, checks, etc. A second guide member 227 having an exit sensor may be positioned at a location along the media path MP downstream of exit nip 238 that is different from the first guide member 225 to similarly detect the presence of a sheet of media as it leaves the fuser nip. A drive train 245, shown in FIGS. 5A and 6B, is positioned on right plate 217R of fuser frame 202 to drive various rolls, such as the hot roll within hot roll fuser assembly 200.

Figure 6B:
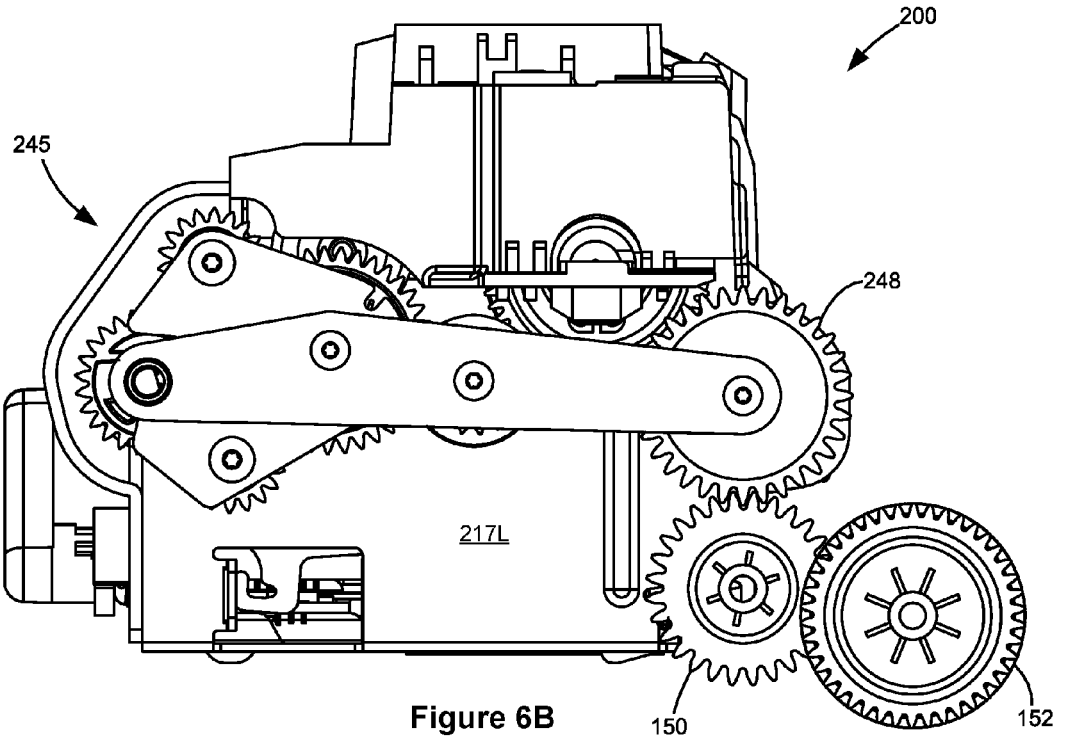

In FIGS. 6A-6B, each of the drive trains 145, 245 is a plurality of intermeshed gears and includes respective compound gears 148, 248 positioned to engage with a common drive gear 150 of imaging device 10 when either of its respective assemblies 100, 200 is installed within imaging device 10. A machine gear 152 of imaging device 10 driven by a motor (not shown) may engage common drive gear 150 for driving common drive gear 150 and other fuser assembly components. While the exemplary embodiment of each of the drive trains 145, 245 is a gear train, those skilled in the art will understand that each of the drive trains 145, 245 may include a series of interconnected gears, a belt drive system of belts and pulleys or a combination of belts, pulleys, and gears. As used herein, the term "drive train" is intended to include such variations, and individual elements such as gears, pulleys or belts of the drive train shall be referred collectively as components of the drive train. Advantageously, all components of each of the drive trains 145, 245 are positioned on right plates 117R, 217R of respective fuser frames 102, 202, such that center distance between gears are easily established and well controlled across all fuser types when either of the fuser assemblies 100, 200 is installed within imaging device 10.

Figure 7A:
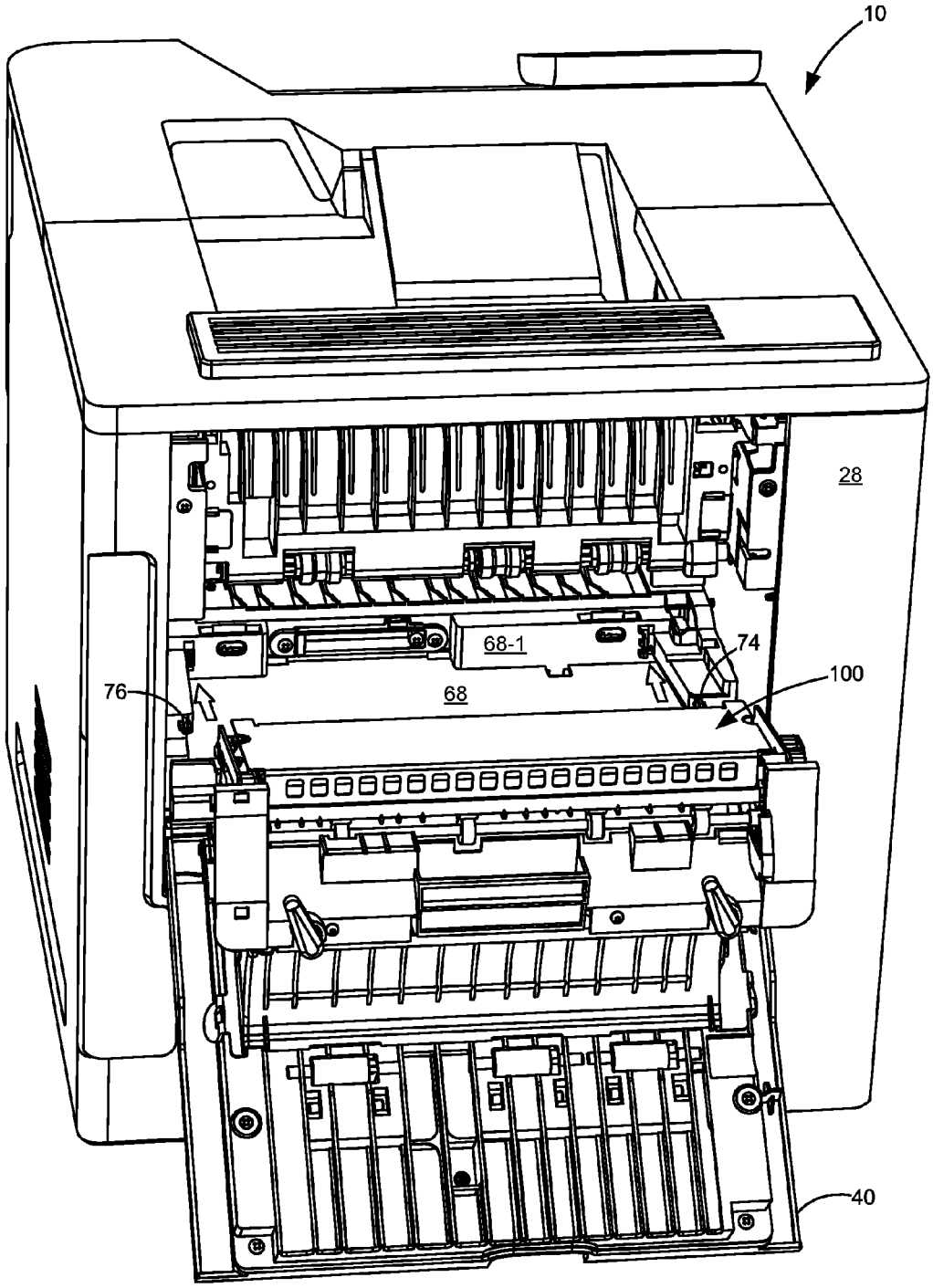
FIG. 7A is a rear perspective view of the imaging device in FIGS. 1A and 1B with the access door open and the fuser assembly being installed thereon, according to an example embodiment.
Figure 7B:
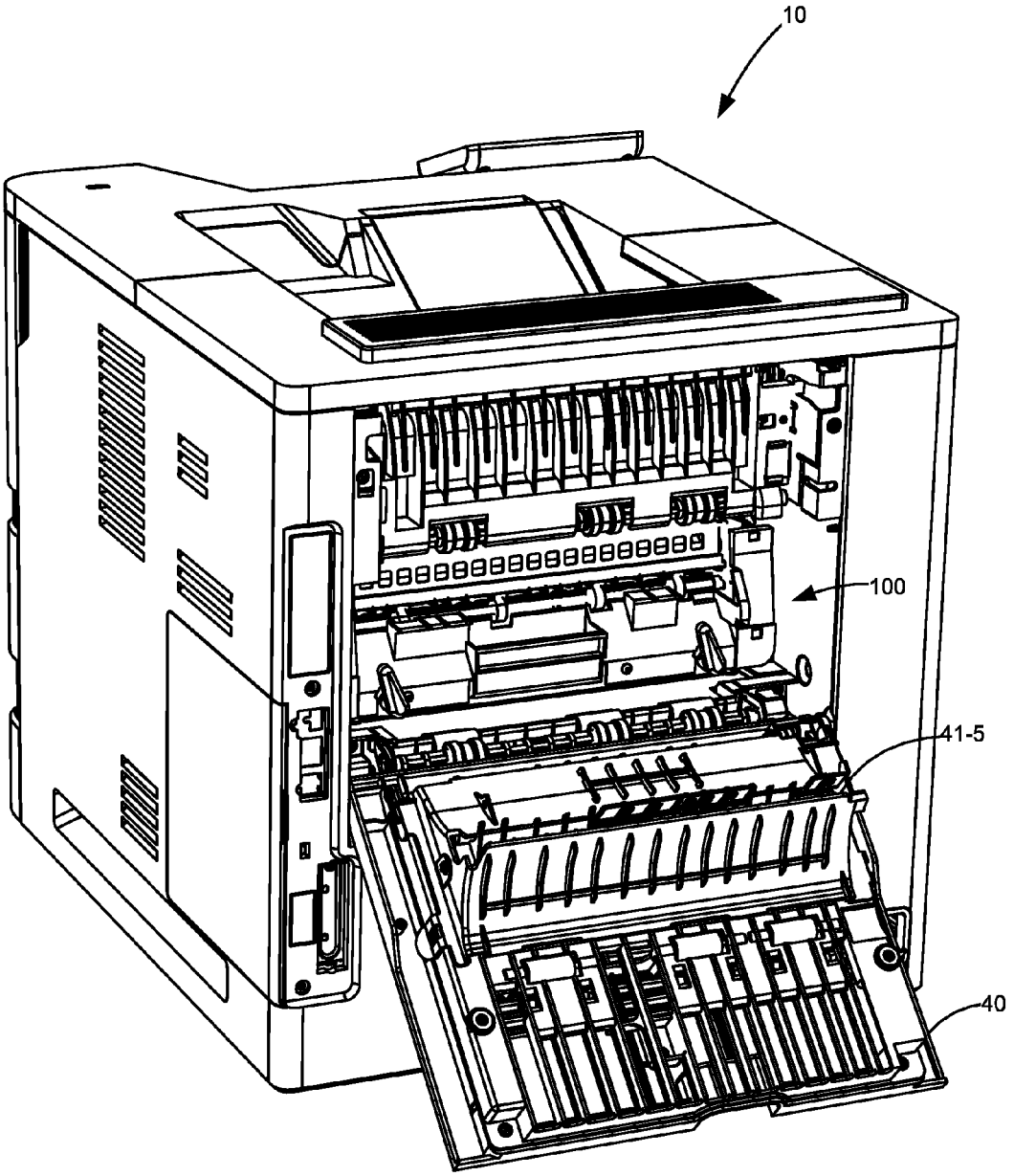
FIG. 7B is a rear perspective view of the imaging device in FIGS. 1A and 1B with the fuser assembly in an operable position.
Figure 8A:
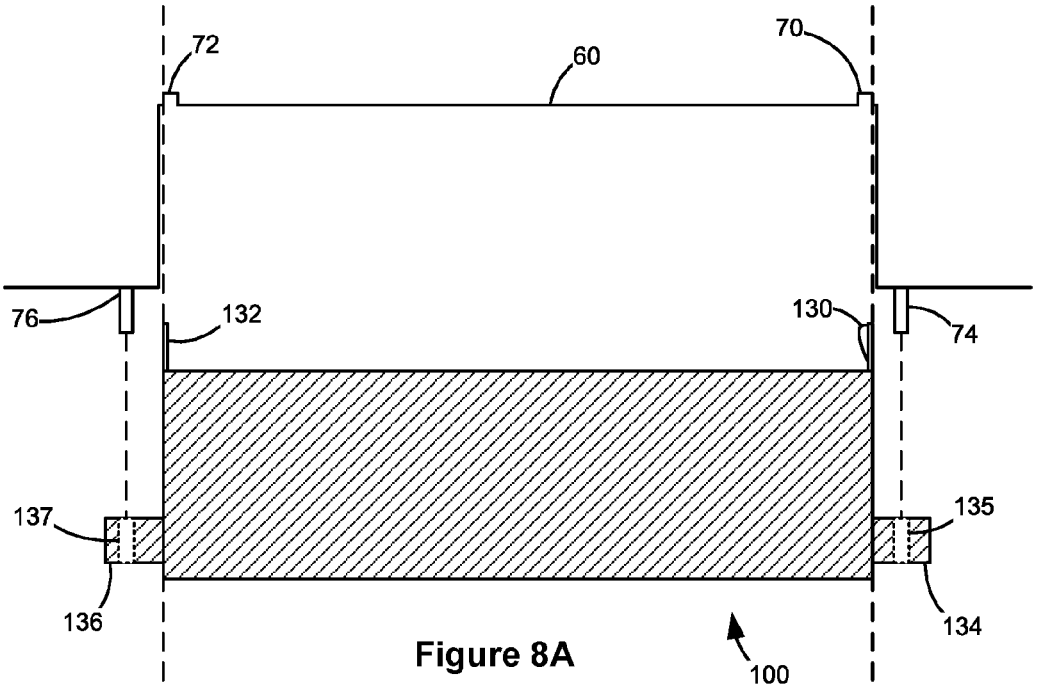
FIGS. 8A and 8B is a schematic illustration showing the removable belt fuser assembly of FIGS. 4A and 4B prior to and after mounting into the imaging device, respectively.
Figure 8B:
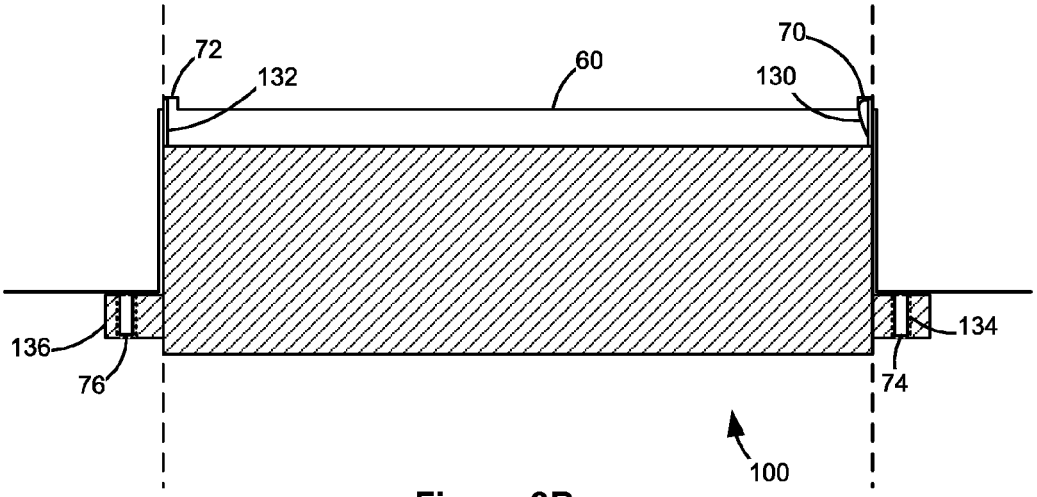

In an example embodiment, FIGS. 7A-7B and 8A-8B show installation of belt fuser assembly 100 within imaging device 10. In FIG. 7A, belt fuser assembly 100 is moved towards operable position thereof within imaging device 10. In FIG. 7B, belt fuser assembly 100 is in the operable position. In another example embodiment, hot roll fuser assembly 200 is installed within imaging device 10 similar to the installation of belt fuser assembly 100 within imaging device 10 as shown in FIGS. 7A-7B. FIGS. 8A-8B are schematic illustrations showing the position of belt fuser assembly 100 before and after mounting of belt fuser assembly 100 within imaging device 10, respectively.

In FIG. 7A, with door 40 at an open position, a first side 68-1 of plate 68 is visible. Back plate 114 of belt fuser assembly 100 is positioned adjacent first side 68-1 of plate 68 when mounting belt fuser assembly 100. With added reference to FIG. 8A, first and second belt fuser datum tabs 130, 132 are aligned with respective first and second datum apertures 70, 72 of plate 68 represented by dashed lines. In a similar manner, respective openings 135, 137 of third and fourth belt fuser datum tabs 134, 136 are aligned with the first and second alignment members 74, 76 of plate 68.

Figure 10A:
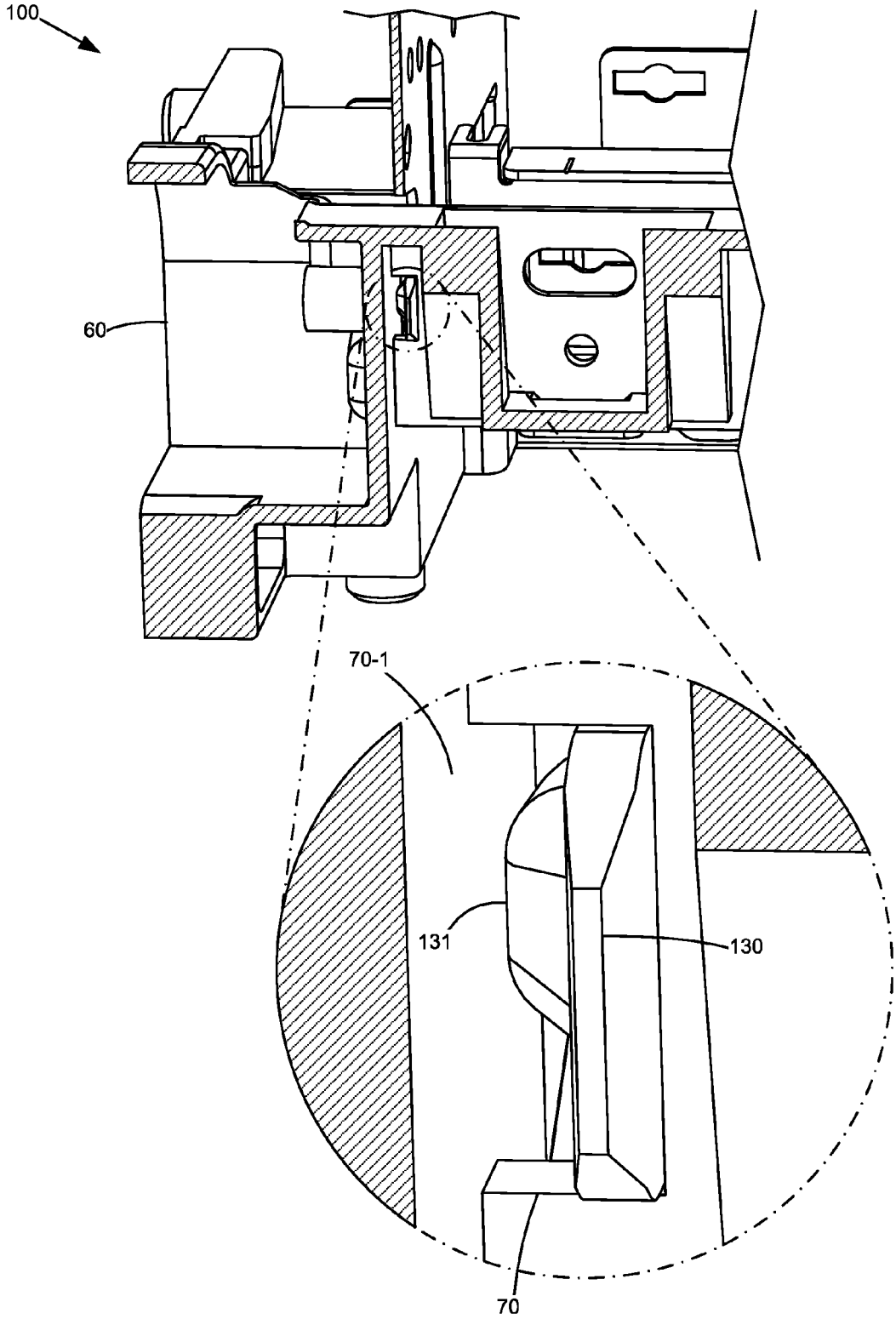
FIGS. 10A and 10B illustrate the belt fuser assembly of FIGS. 4A and 4B and the hot roll fuser assembly of FIGS. 5A and 5B in the operable position, respectively.
Figure 11:
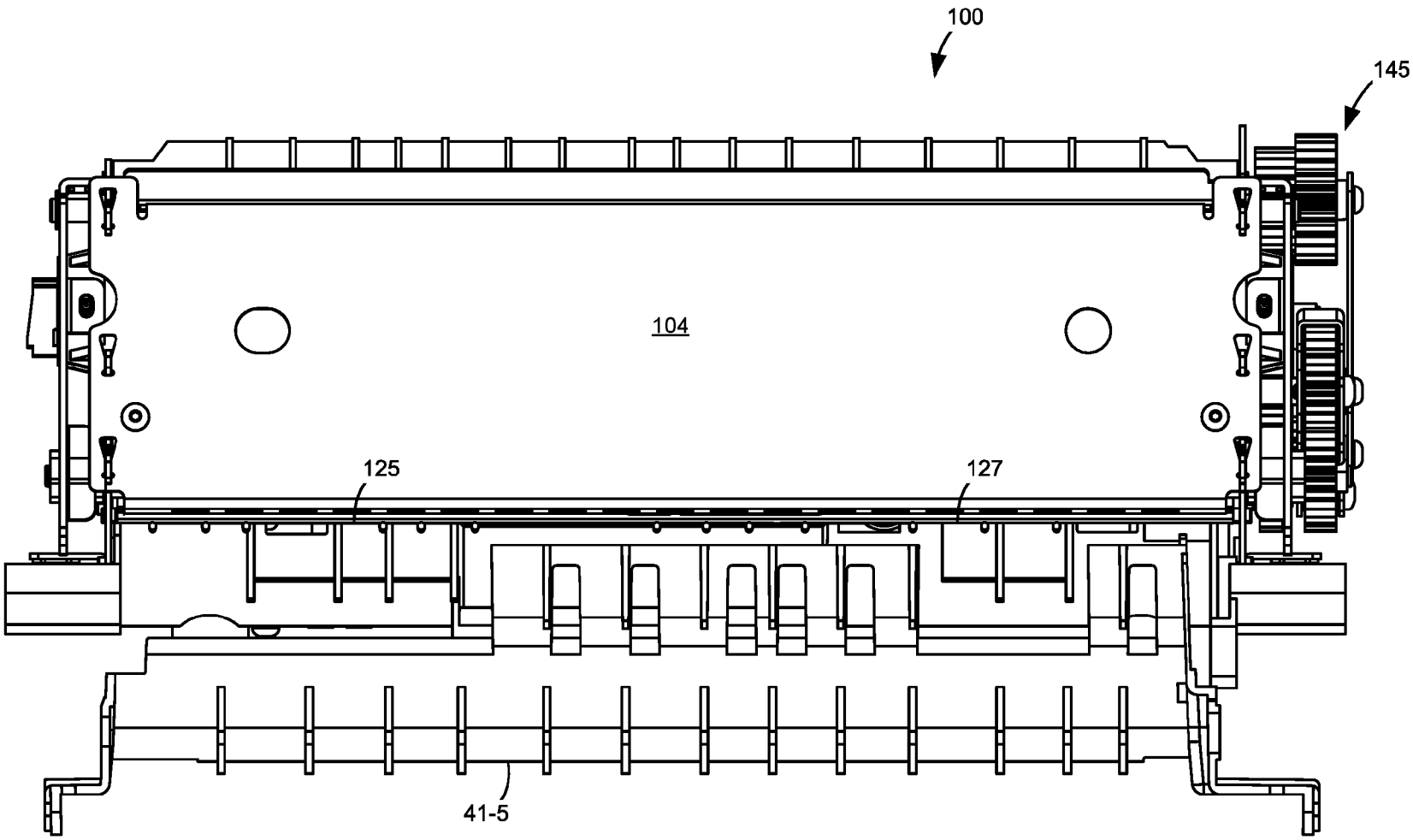
FIG. 11 is a top perspective view of the belt fuser assembly of FIGS. 4A and 4B when the access door of the imaging device is in the closed position.

FIG. 7B shows belt fuser assembly 100 mounted within imaging device 10. With added reference to FIGS. 8B and 10A, first and second belt fuser datum tabs 130, 132 are inserted into respective first and second datum apertures 70, 72 of plate 68. Protrusion 131 of first belt fuser datum tab 130 contacts a first edge 70-1 of first datum aperture 70, filling up the gap within first datum aperture 70 to accurately position belt fuser assembly 100 at the operative position within imaging device 10. In addition, each of the third and fourth belt fuser datum tabs 134, 136 receives respective first and second alignment members 74, 76. Further, when door 40 is in the closed position, guide members 125, 127 interleave with media guide member 41-5 (FIG. 11) to form an exit media guide surface for feeding media sheet to media output area 38 (FIG. 3).

Figure 9A:
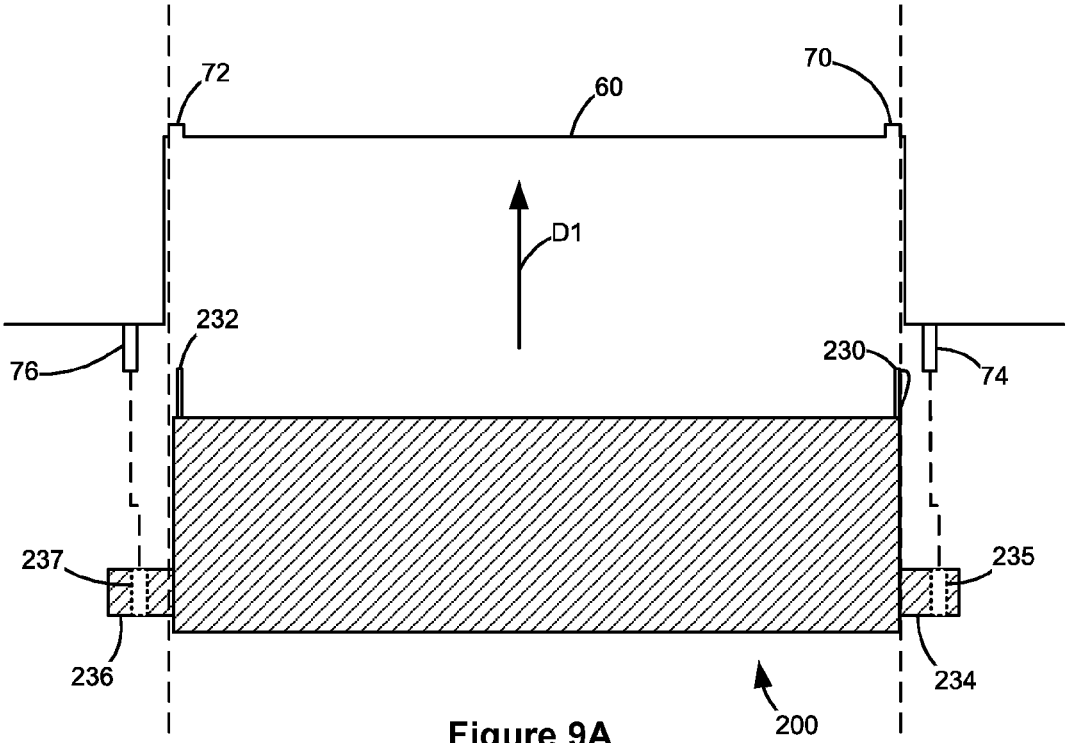
FIGS. 9A and 9B are schematic illustrations showing the removable hot roll fuser assembly of FIGS. 4A and 4B prior to and after mounting into the imaging device, respectively.
Figure 9B:
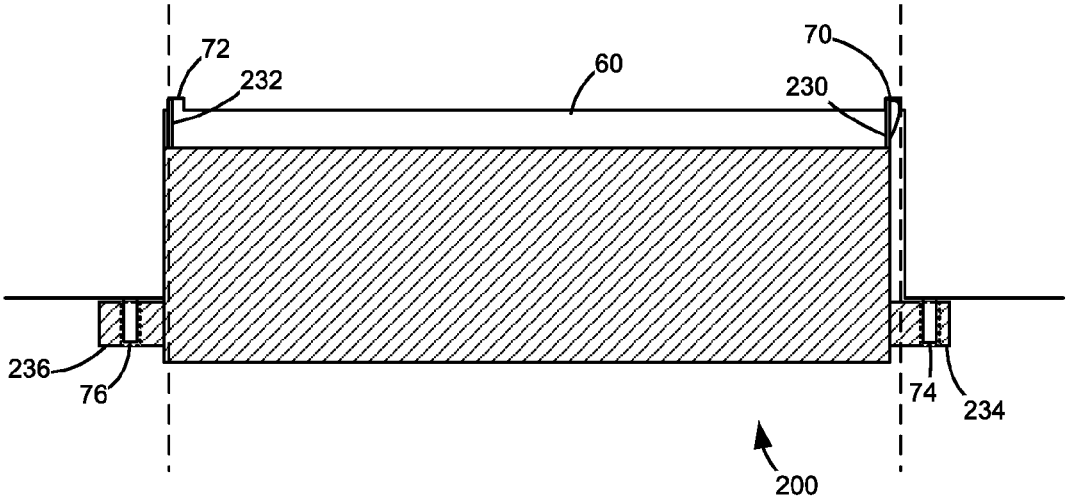

In another example embodiment, back plate 214 of hot roll fuser assembly 200 is positioned adjacent first side 68-1 of plate 68 when mounting hot roll fuser assembly 200. FIGS. 9A-9B are schematic illustrations showing the position of hot roll fuser assembly 200 before and after mounting hot roll fuser assembly 200 within imaging device 10, respectively. With reference to FIG. 9A, first and second hot roll fuser datum tabs 230, 232 are aligned with the first and second datum apertures 70, 72 of plate 68 represented by dashed lines. In a similar manner, respective openings 235, 237 of third and fourth hot roll fuser datum tabs 234, 236 are aligned with the first and second alignment members 74, 76 of plate 68.

Figure 10B:
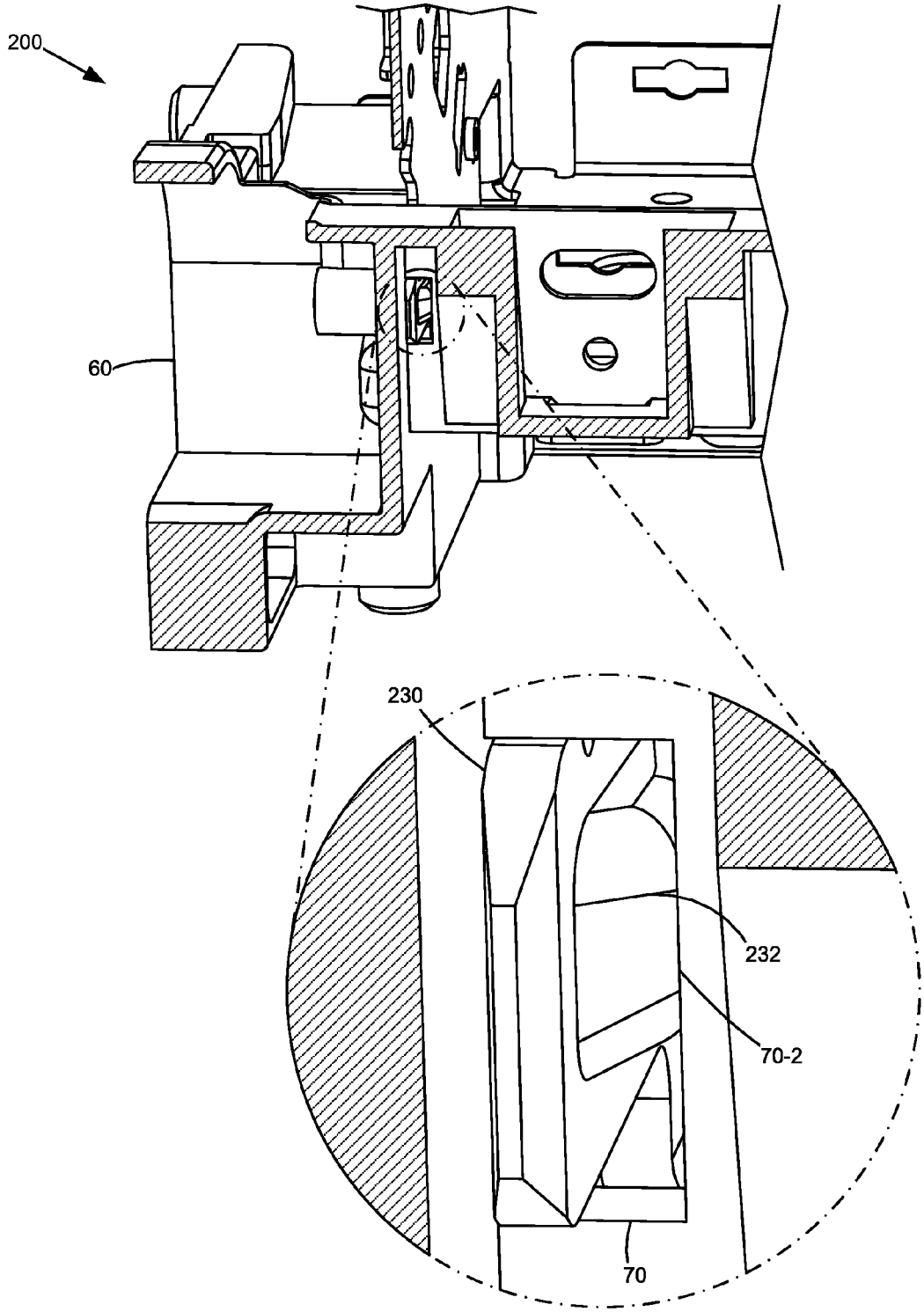

As hot roll fuser assembly 200 is mounted into imaging device 10, first and second hot roll fuser datum tabs 230, 232, as shown in FIGS. 9B and 10B, are inserted into respective first and second datum apertures 70, 72 of plate 68. Protrusion 231 of first hot roll fuser datum tab 230 contacts a second edge 70-2 of first datum aperture 70 causing the hot roll fuser assembly 200 to move in a direction D1, as shown in FIG. 9A, towards the operative position until first hot roll fuser datum tab 230 is fully inserted into first datum aperture 70. Such mounting design is fundamentally needed in order for each of the respective fuser frames 102, 202 of belt fuser and hot roll fuser assemblies 100, 200 to maintain common machine frame features, critical technology components, and media to fuser position. Further, when door 40 is in the closed position, guide members 225, 227 interleave with media guide member 41-5 to form an exit media guide surface for feeding media sheet to media output area 38 (FIG. 3). Electrical connectors 128, 228 establish electrical connection between respective fuser assemblies 100, 200 and the power supply in imaging device 10 and automatically adjusts engine code settings such as temperature controls, temperature set points, paper path sensing timings, and roller speeds which are optimized for the belt fuser architecture by sending a signal to controller 65 based on the sensed fuser type.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

The invention claimed is:

1. An imaging device, comprising:

at least one photoconductive member;

at least one developer unit for developing a toner image on the at least one photoconductive member;

at least one toner transfer area for transferring the toner image to a sheet of media as the sheet of media passes through the toner transfer area in a media feed direction; and a frame to which the at least one photoconductive member and the at least one developer unit are mounted, the frame configured to separately receive a first fuser assembly of a first fuser type and a second fuser assembly of a second fuser type different from the first fuser type, wherein the first fuser assembly is removably mounted to the frame at a first operative position when the first fuser assembly is installed in the imaging device, and the second fuser assembly is removably mounted to the frame at a second operative location different from the first operative position when the second fuser assembly is installed in the imaging device, and wherein the first fuser assembly includes a first fuser frame having a first datum tab extending from the first fuser frame, and the second fuser assembly includes a second fuser frame having a second datum tab extending from the second fuser frame, the frame of the imaging device having a datum aperture that is sized to receive the first datum tab when the first fuser assembly is installed in the imaging device and the second datum tab when the second fuser assembly is installed in the imaging device, the first datum tab having a first shape that, when inserted into the datum aperture, causes the first fuser assembly to be positioned at the first operative position, and the second datum tab having a second shape that, when inserted into the datum aperture, causes the second fuser assembly to be positioned at the second operative position.

2. The imaging device of claim 1, wherein each of the first and second fuser frames further includes a first side and an opposed second side, the first datum tab extending from the first side of the first fuser frame and the second datum tab extending from the first side of the second fuser frame, each of the first and second datum tabs is aligned with the datum aperture of the frame when inserted therein.

3. The imaging device of claim 1, wherein the datum aperture of the frame includes a first edge and a second edge opposite to the first edge, the first datum tab including a first protrusion projecting from the first datum tab in a first direction, the first protrusion contacting the first edge of the datum aperture when the first fuser assembly is in the first operative position, the second datum tab including a second protrusion projecting from the second datum tab in a second direction opposite to the first direction, the second protrusion contacting with the second edge of the datum aperture when the second fuser assembly is in the second operative position, the second fuser assembly in the second operative position within the imaging device being laterally offset from the first fuser assembly in the first operative position within the imaging device.

4. The imaging device of claim 1, further comprising a housing, and an access door on the housing having a media guide member attached thereto, the access door manually movable between a closed position and an open position, the access door substantially forming a first side of the imaging device when in the closed position and permitting access to an interior of the housing when in the open position, wherein each of the first and second fuser frames further includes a fuser nip, an exit roll pair defining an exit nip downstream of the fuser nip in the media feed direction, a pair of guide members positioned downstream of the exit nip in the media feed direction, the pair of guide members interleaving with the media guide member attached to an access door of the imaging device to form an exit media guide surface for receiving fused media exiting the exit nip, and a media sensor for sensing media exiting the fuser nip, wherein the media sensor of the first fuser assembly is disposed upstream of the exit nip of the first fuser assembly in the media feed direction and the media sensor of the second fuser assembly is disposed downstream of the exit nip of the second fuser assembly on one guide member of the pair of guide members of the second fuser assembly.

5. The imaging device of claim 4, further comprising a drive gear for interfacing with the first and second fuser assemblies, the first fuser assembly including a first backup roll rotatably mounted to the first fuser frame and a first gear coupled to the first backup roll and positioned to receive a rotational force from the drive gear when the first fuser assembly is installed in the imaging device, and the second fuser assembly including a second backup roll rotatably mounted to the second fuser frame and a second gear coupled to the second backup roll and positioned to receive the rotational force from the drive gear when the second fuser assembly is installed in the imaging device.

6. The imaging device of claim 1, wherein the first fuser assembly is a belt fuser assembly.

7. The imaging device of claim 6, wherein the second fuser assembly is a hot roll fuser assembly.

8. The imaging device of claim 7, wherein the hot roll fuser assembly further includes a second media sensor disposed on the second guide member of the pair of guide members of the second fuser assembly, the second media sensor for sensing narrow media.

9. An imaging device, comprising:

a housing;

an access door on the housing having a media guide member attached thereto, the access door manually movable between a closed position and an open position, the access door substantially forming a first side of the image forming device when in the closed position and permitting access to an interior of the housing when in the open position; and a frame configured to separately receive a first fuser assembly of a first type and a second fuser assembly of a second type, each of the first and second fuser assemblies having a fuser nip, an exit roll pair defining an exit nip downstream of the fuser nip in a media feed direction, a pair of guide members positioned downstream of the exit nip in the media feed direction, the pair of guide members interleaving with the media guide member attached to the access door to form an exit media guide surface for receiving fused media exiting the exit nip, and a media sensor for sensing media exiting the fuser nip, wherein the media sensor of the first fuser assembly is disposed upstream of the exit nip of the first fuser assembly in the media feed direction and the media sensor of the second fuser assembly is disposed downstream of the exit nip of the second fuser assembly in the media feed direction on one of the pair of guide members of the second fuser assembly.

10. The imaging device of claim 9, wherein the first fuser assembly further includes a first fuser frame having a first datum tab extending from the first fuser frame, and the second fuser assembly further includes a second fuser frame having a second datum tab extending from the second fuser frame, the frame of the imaging device having a datum aperture that is sized to receive the first datum tab when the first fuser assembly is installed in the imaging device and the second datum tab when the second fuser assembly is installed in the imaging device, the first datum tab having a first shape that, when inserted into the datum aperture, causes the first fuser assembly to be positioned at a first operative position, and the second datum tab having a second shape that, when inserted into the datum aperture, causes the second fuser assembly to be positioned at a second operative position different from the first operative position.

11. The imaging device of claim 10, wherein the datum aperture of the frame includes a first edge and a second edge opposite to the first edge, the first datum tab including a first protrusion projecting from the first datum tab in a first direction, the first protrusion contacting the first edge of the datum aperture when the first fuser assembly is in the first operative position and the second datum tab including a second protrusion projecting from the second datum tab in a second direction opposite to the first direction, the second protrusion contacting with the second edge of the datum aperture when the second fuser assembly is in the second operative position, the second fuser assembly in the second operative position within the image forming device being laterally offset from the first fuser assembly in the first operative position within the image forming device.

12. The imaging device of claim 10, further comprising a drive gear for interfacing with one of the first and second fuser assemblies, the first fuser assembly including a first backup roll rotatably mounted to the first fuser frame and a first gear coupled to the first backup roll and positioned to receive a rotational force from the drive gear when the first fuser assembly is installed in the imaging device, and the second fuser assembly including a second backup roll rotatably mounted to the second fuser frame and a second gear coupled to the second backup roll and positioned to receive the rotational force from the drive gear when the second fuser assembly is installed in the imaging device.

13. The imaging device of claim 9, wherein the first fuser assembly is a belt fuser assembly.

14. The imaging device of claim 13, wherein the second fuser assembly is a hot roll fuser assembly.

15. The imaging device of claim 14, wherein the hot roll fuser assembly further includes a second media sensor disposed on the second guide member of the pair of guide members of the second fuser assembly, the second media sensor for sensing narrow media.

* * * * *